US009316046B2

(12) United States Patent
Nerden

(10) Patent No.: US 9,316,046 B2
(45) Date of Patent: Apr. 19, 2016

(54) VIEWING PANEL UNIT AND STRUCTURES COMPRISING THE VIEWING PANEL UNIT

(71) Applicant: VISTAMATIC LIMITED, Hainault Essex (GB)

(72) Inventor: John D. Nerden, Chigwell Essex (GB)

(73) Assignee: VISTAMATIC LIMITED, Hainault Essex (GB)

( * ) Notice: Subject to any disclaimer, the term of this patent is extended or adjusted under 35 U.S.C. 154(b) by 0 days.

(21) Appl. No.: 14/352,813

(22) PCT Filed: Oct. 1, 2012

(86) PCT No.: PCT/GB2012/052422
§ 371 (c)(1),
(2) Date: Apr. 18, 2014

(87) PCT Pub. No.: WO2013/057475
PCT Pub. Date: Apr. 25, 2013

(65) Prior Publication Data

US 2014/0311687 A1 Oct. 23, 2014

(30) Foreign Application Priority Data

Oct. 20, 2011 (GB) ..... 1118162.5

(51) Int. Cl.
*E06B 7/30* (2006.01)
*E06B 9/04* (2006.01)

(52) U.S. Cl.
CPC .... *E06B 7/30* (2013.01); *E06B 9/04* (2013.01)

(58) Field of Classification Search
CPC ..... E06B 7/30; E06B 9/04
USPC ..... 160/130, 222, 224, 225; 359/596, 359/486.02, 490.03; 49/63
See application file for complete search history.

(56) References Cited

U.S. PATENT DOCUMENTS 2,205,523 A 6/1940 Galey
2,302,507 A * 11/1942 Ryan ..... 359/489.07

(Continued)

FOREIGN PATENT DOCUMENTS

GB 1296594 A 11/1972
GB 1459639 A 12/1976

(Continued)

OTHER PUBLICATIONS

Great Britain Search Report, dated Jan. 5, 2012 on British application No. GB1118162.5.
PCT International Search Report dated Jan. 16, 2013.

*Primary Examiner* — Blair M Johnson
(74) *Attorney, Agent, or Firm* — Harness, Dickey & Pierce, P.L.C.

(57) ABSTRACT

There is disclosed a viewing panel unit, comprising: a first panel and a second panel; a drive mechanism for moving the first panel relative to the second panel; and an abutment member mounted so as to have a fixed spatial relationship relative to the second panel, wherein: the first panel comprises a coupling member; the drive mechanism comprises a drive member configured to engage with the coupling member such that rotation of the drive member imparts a linear motion to the first panel via the coupling member; and the drive mechanism is configured such that a first impact surface of the drive member is brought into contact with a surface of the abutment member to stop the drive member when the drive member is rotated through a maximum angle in a first sense.

24 Claims, 4 Drawing Sheets

(56) References Cited

U.S. PATENT DOCUMENTS

| | | | | | |
|---|---|---|---|---|---|
| 2,617,329 | A | * | 11/1952 | Dreyer | 359/486.02 |
| 3,049,051 | A | * | 8/1962 | Debrie | 396/661 |
| 5,164,856 | A | * | 11/1992 | Zhang et al. | 359/486.02 |
| 5,940,216 | A | | 8/1999 | Gibbs | |
| 8,959,835 | B2 | * | 2/2015 | Drohan | 49/63 |
| 9,001,405 | B2 | * | 4/2015 | Nerden | 359/233 |
| 2014/0311687 | A1 | * | 10/2014 | Nerden | 160/130 |

FOREIGN PATENT DOCUMENTS

| | | | | |
|---|---|---|---|---|
| GB | 347476 | | * | 4/1981 |
| GB | 2461347 | A | | 1/2010 |
| GB | 2480303 | | * | 11/2011 |
| GB | 2494680 | | * | 3/2013 |
| GB | 2509310 | | * | 7/2014 |

* cited by examiner

VIEWING PANEL UNIT AND STRUCTURES COMPRISING THE VIEWING PANEL UNIT

CROSS-REFERENCE TO RELATED APPLICATIONS

This application is a 371 U.S. National Stage of International Application No. PCT/GB2012/052422 filed on Oct. 1, 2012, which claims priority to British Patent Application No. 1118162.5 filed on Oct. 20, 2011. The contents of the above applications are incorporated herein by reference in their entirety.

The present invention relates to viewing panels with an optional through-vision facility.

Panels with an optional through-vision facility (i.e. panels that can be switched between a state in which they can be seen through and a state in which they cannot be seen through) are known. They can be used in hospital doors or windows to provide privacy for patients, for example. They can also be used in other areas that require privacy and/or security, for example in nursing homes, banks, offices, laboratories, post offices, nurseries and private residences.

GB 1296594 discloses an example of such a system comprising a pair of outer panels secured in a rigid frame and a centre panel slidably sandwiched between them. The centre panel and one or both of the outer panels have areas of reduced transparency, such that sliding movement of the centre panel with respect to the outer panels causes a variation in the extent to which it is possible to see through the sheet. An actuator is provided to allow the centre panel to be moved by turning a handle protruding to the outside.

A common configuration for such viewing panels is with the centre panel moveable in a vertical direction relative to the outer panels. In such a configuration, the panels may be provided with horizontal stripes defining regions that are substantially transparent and regions that are substantially opaque. When opaque stripes on the centre panel are made to line up with and block transparent stripes on one or both of the outer panels, by appropriate vertical positioning of the centre panel, the viewing panel unit blocks through-vision. Conversely, when the centre panel is moved to a position in which its transparent stripes are aligned with transparent stripes on the outer panels, through-vision is allowed.

In order to create a satisfactory aesthetic experience for a user when he or she is moving the centre panel in such a configuration, both the gravitational force on the panel and the force from the actuator may be relevant because these forces are parallel or anti-parallel to each other.

It is also possible to arrange for the centre panel to move horizontally relative to the outer panels. In such a configuration, substantially opaque and transparent regions may also be provided in the form of stripes. In this case, the stripes would typically be arranged vertically.

In arrangements based on horizontal motion of the centre panel, the force provided by the actuator will tend to be perpendicular, rather than parallel or anti-parallel, to the force of gravity on the centre panel. The technical considerations necessary to create a satisfactory aesthetic experience when actuating the centre panel are thus quite different to those that are relevant for a vertically moving centre panel. In particular, it is no longer possible to rely on gravity to stop the motion of the centre panel and/or it may be more difficult to prevent torques from acting on the centre panel when the centre panel is forced to stop.

Aspects of the aesthetic experience include the following: 1) the appearance of the panel during actuation, including the precision with which stripes can be made to align with each other at ends of the actuation range; 2) the sound associated with actuation, including the sound that is made when the centre panel reaches the ends of the actuation range; and 3) the feeling associated with actuation, including the feeling experienced when the centre panel reaches the ends of the actuation range.

Reliability and longevity are also important issues to consider. The material used for constructing the inner panel will generally be very brittle and hard. Repeated impact with such material may risk damage to the material itself or to the material with which the inner panel in brought into contact. In addition, repeated contact with the inner panel may favour the accumulation of contaminants on the panel, which over time may migrate towards centre regions of the panel and negatively affect the visual appearance of the panel.

It is an aim of the present invention to at least partially address one or more of the issues discussed above.

According to an aspect of the invention, there is provided a viewing panel unit, comprising: a first panel and a second panel; a drive mechanism for moving the first panel relative to the second panel; and an abutment member mounted so as to have a fixed spatial relationship relative to the second panel, wherein: the first panel comprises a coupling member; the drive mechanism comprises a drive member configured to engage with the coupling member such that rotation of the drive member imparts a linear motion to the first panel via the coupling member; and the drive mechanism is configured such that a first impact surface of the drive member is brought into contact with a surface of the abutment member to stop the drive member when the drive member is rotated through a maximum angle in a first sense.

Arranging for the movement of the first panel to be stopped by means of an impact between the drive member and the abutment member provides the basis for improving the aesthetic experience of a user and for improving reliability and longevity.

Using an impact between the drive member and the abutment member rather than between the first panel itself and an abutment member makes it possible to ensure that the impact takes place at a well defined position or range of positions, and in a predictable manner. Although the stopping of the drive member may impart a torque to the first panel via the engagement between the drive member and the coupling member, such a torque is easier to compensate than torques applied via other impact or connection points. This is because where provisions to control torque caused by the driving operation of the drive member are provided, these provisions will also tend to control any torque which results from the stopping operation, because both types of torque are applied via the same connection point. No extra apparatus is therefore necessary to compensate for torques applied due to the stopped motion. Insufficient control of torques on the first panel may result in slight rotations of the first panel relative to the second panel. Any such rotations could cause stripes on different panels to be no longer accurately parallel.

Using an abutment member to stop movement of the drive member (rather than the first panel) also reduces the need to provide extra apparatus (such as an abutment member to impact against the first panel directly) around the periphery of the first panel, thus improving compactness, at least in the lateral direction.

The material of the drive member does not have to have the same optical properties as the first panel. There is thus more freedom for choosing the material of the drive member so that it is suitable for withstanding impacts. For example, a material that is less brittle than the first panel could be chosen to improve reliability. A material that is softer than the first panel may be chosen to provide a more agreeable feedback to the user (e.g. to prevent an abrupt shock travelling back to the user) and/or to reduce the sound that is associated with the first panel reaching the end of its range.

In the alternative case where the panel itself impacts with an abutment member (not required by the present invention), a damping mechanism could be provided to reduce the shock and/or sound associated with impact between the first panel and an abutment member, but such a damping member would increase the bulk of the viewing panel unit. In addition, such a damping member may reduce the precision with which the first panel reaches its stopped position. In addition, the contact between the first panel and the abutment member and/or damping member provides a potential source of contamination or dust onto the first panel. Arranging for the impact to occur between the drive member and the abutment member minimizes the need for contact between the first panel and other apparatus and therefore reduces the possibility of such contamination.

The abutment member may optionally be substantially planar and/or parallel to the direction of linear motion of the first panel. This arrangement facilitates use of the same abutment member for stopping motion of the drive member in both rotational senses. Such a member is also easy to manufacture and align accurately.

The drive member may comprise an arc-shaped drive member engaging structure (comprising, for example, an arc of teeth). The drive member may comprise first and second lateral surfaces that extend away from the direction of the arc. The lateral surfaces may provide a connection to a rotatable axis. In such embodiments, the first impact surface may be positioned at the point of intersection between one of the lateral surfaces and the drive member engaging structure. In this way, the first impact surface is positioned far from the axis of rotation of the drive member and is therefore able to provide a given torque to the drive member with a minimum of impact force against the abutment member.

The viewing panel unit may further comprise a support member for engaging slidably with a lower surface of the first panel in order to support the weight of the first panel. The support member may be spaced apart from the region of engagement between the drive member and the coupling member in a direction parallel to the direction of linear motion of the first panel relative to the second panel. The positioning of a support member in this way enables the support member to provide a torque to the first panel that is in the opposite sense to the torque applied to the first panel by the drive member. The support member therefore helps to ensure that movement of the first panel remains accurate and reliable. Avoiding rotations of the first panel also helps to ensure that the movement is smooth. In an embodiment, the support member may comprise a low friction surface, such as PTSE, or a roller, for example.

In order to maximize the capability of the support member to provide a counter torque with a minimum of force between the support member and the first panel, the support member may be positioned close to one of the laterally outer edges of the first panel. For example, the support member may be positioned so as to come into contact with the first panel at a position that is within 10% of the distance between the two vertical edges of the first panel of the nearest one of the two vertical edges (in the case where the first panel is rectangular or square). In the case where the first panel is not rectangular or square, the support member may be configured to come into contact with the first panel at a position that is within 10% of the width of the first panel to the nearest edge that is angled significantly away from the lowermost edge of the first panel.

Embodiments of the invention will now be described, by way of example only, with reference to the accompanying schematic drawings in which corresponding reference symbols indicate corresponding parts, and in which.

Figure 1:
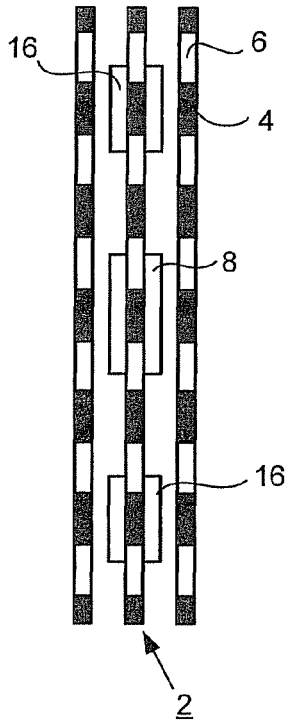
FIG. 1 is a schematic top view of a viewing panel unit having a moveable centre panel in which the centre panel is positioned so as to allow through-vision.
Figure 2:
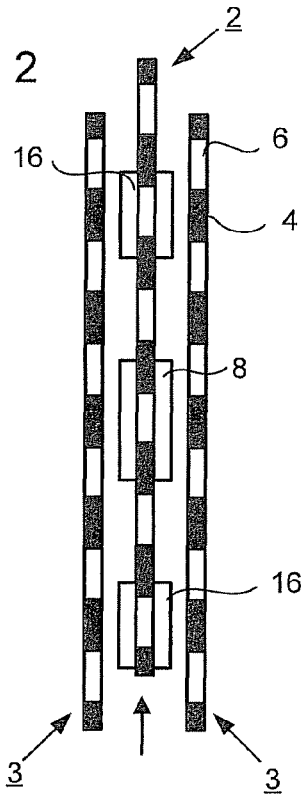
FIG. 2 is a schematic top view of a viewing panel unit of the type depicted in FIG. 1 where the centre panel has been displaced horizontally in order to block through-vision.
Figure 3:
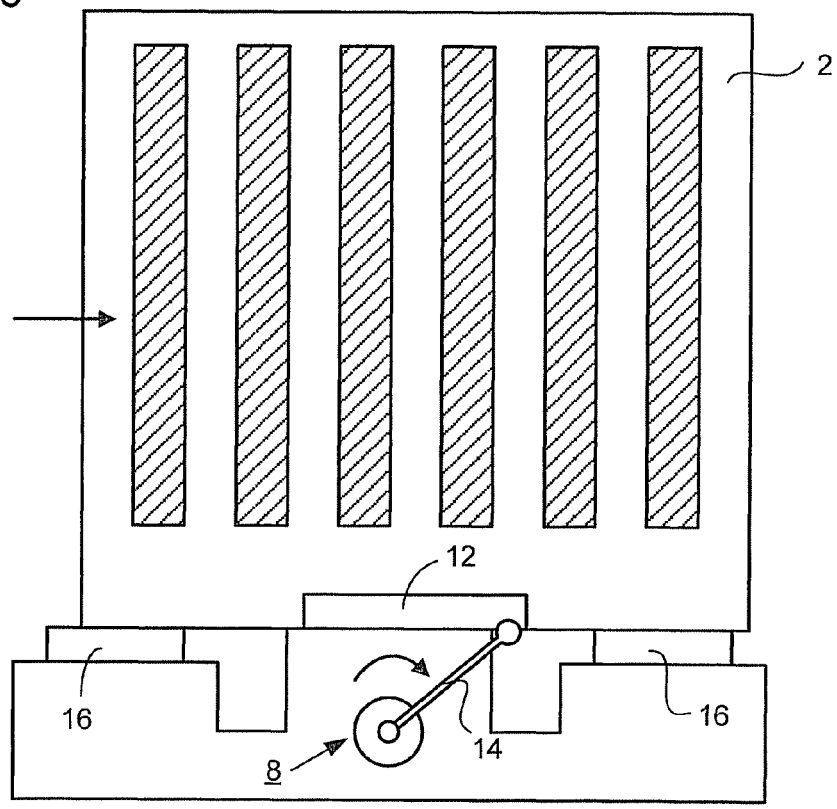
FIG. 3 is a schematic side view of a viewing panel unit of the type depicted in FIGS. 1 and 2.

FIGS. 1 to 3 illustrate an example viewing panel unit. FIGS. 1 and 2 are schematic top views. FIG. 3 is a side view with the outer panels removed. The centre panel 2 of the viewing panel unit is moveable horizontally to allow switching between a state in which through-vision is allowed (FIG. 1) and a state in which through-vision is blocked (FIG. 2). In the examples shown, the three panels are provided with vertical stripes 4 and 6. The stripes 4 are substantially opaque ("light hindering regions") and the stripes 6 are substantially transparent ("light transparent regions"). The opaque stripes 4 may comprise an opaque coating formed on one or both surfaces of the panel. Alternatively, the panel may be opaque all the way through. In the example shown, a pattern (in this case stripes) is formed on both of the outer panels 3. However, this is not necessary to provide the through-vision blocking/allowing functionality. In alternative embodiments, the pattern may be provided on only one of the two outer panels.

A drive mechanism 8 may be provided for driving movement of the centre panel 2 relative to the outer panels 3. The drive mechanism may comprise a drive member 10 (see FIGS. 4 to 8) that is configured to engage with a coupling member 12 that is rigidly connected to the centre panel 2. Rotation of the drive member imparts a linear motion to the centre panel 2 via the coupling member 12. The rotation of the drive member 10 may be driven by the rotation of a handle 14 by a user. The handle 14 may protrude, for example, to the exterior of the viewing panel unit. In alternative embodiments, the drive member may be driven to rotate by a motor, which may be housed within the viewing panel unit or within the structure within which the viewing panel unit is housed. In configurations of this type, the motor may be controlled by the user remotely using a wired or wireless connection in manners that are well known in the art.

In the arrangement shown in FIG. 3, the handle 14 has been rotated clockwise to provide a corresponding rotation to the drive member and a corresponding linear displacement of the centre panel to the right. In order to provide a smooth motion, the viewing panel unit may comprise one or more support members 16. In the example shown in FIGS. 1 to 3, two such support members 16 are provided. In other embodiments, only one support member may be provided, or more than two support members may be provided. The support members 16 are discussed further below with reference to FIGS. 9 and 10.

Figure 4:
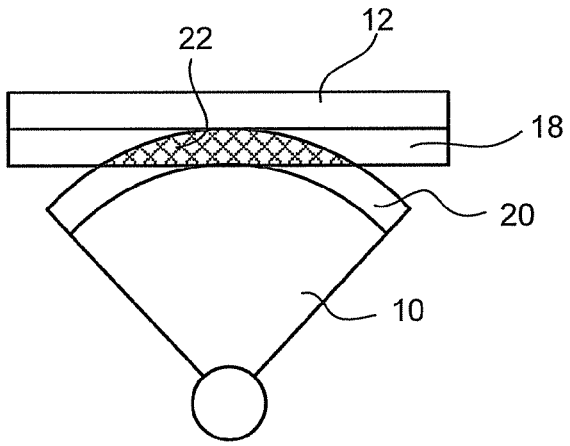
FIG. 4 is a schematic side view showing engagement between a drive member of a drive mechanism and a coupling member of a moveable panel.

FIGS. 4 to 8 illustrate operation of the drive mechanism in further detail. As shown in FIG. 4, the drive member 10 of the drive mechanism is configured to interact with a coupling member 12. The interaction between the drive member 10 and the coupling member 12 occurs via an engagement between a drive member engaging structure 20 of the drive member 10 and a coupling member engaging structure 18 of the coupling member 12. The region of engagement between the engagement structures 18, 20 is shown using cross-hatching 22.

In an embodiment, the drive member engaging structure 20 takes the form of an arc having a constant radius of curvature. In this way, the drive member engaging structure 20 can easily be made to move in a direction parallel to the coupling member engagement structure 18 at the point of intersection between the engagements structures 18, 20, through a range of angular positions of the drive member 10.

The coupling member engaging structure may take a linear form.

In an embodiment, the drive member engaging structure comprises an arc of teeth extending radially outwards in the manner of a cog. In an embodiment, the coupling member engaging structure comprises a linear rack of teeth having dimensions that are suitable for engaging with the arc of teeth of the drive member engaging structure 20.

Figure 5:
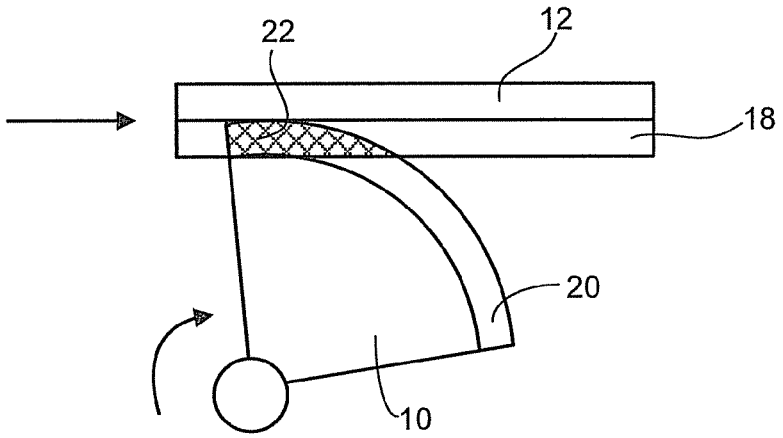
FIG. 5 is a schematic view of the arrangement of FIG. 4 in which the drive member has been rotated clockwise in order to provide a horizontal movement to the right to the coupling member.

FIG. 5 illustrates how a clockwork rotation of the drive member 10 in an example configuration will cause a linear motion to the right of the coupling member 12 via the engagement between the engaging structures 18, 20.

Figure 6:
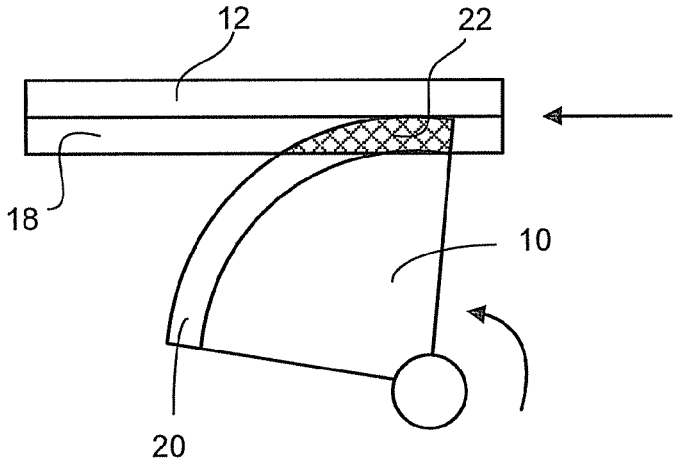
FIG. 6 is a schematic view of the arrangement of FIGS. 4 and 5 in which the drive member has been rotated anticlockwise in order to provide a horizontal movement to the left to the coupling member.

FIG. 6 shows the equivalent motion to the left caused by an anticlockwise motion of the drive member 10.

Figure 7:
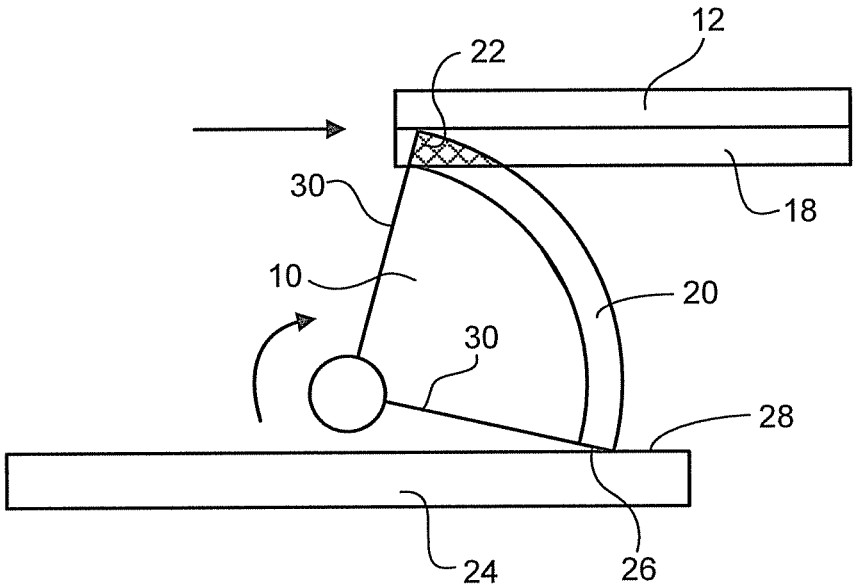
FIG. 7 is a schematic illustration showing how an impact surface of the drive member is brought into contact with a surface of an abutment member when the drive member is rotated through a maximum angle clockwise.
Figure 8:
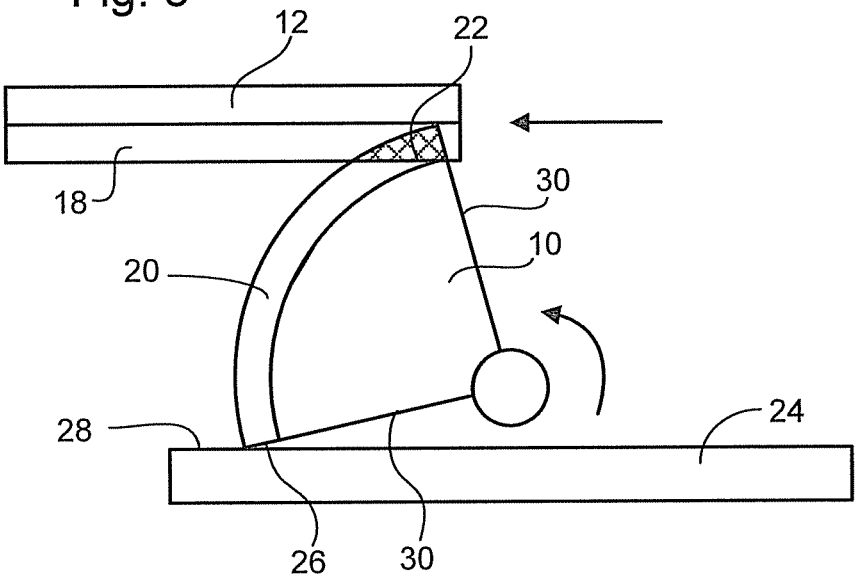
FIG. 8 depicts the arrangement of FIG. 7 in the case where the drive member is rotated through a maximum angle anticlockwise.

FIGS. 7 and 8 illustrate how movement of the centre panel 2 at the ends of its allowed range may be stopped. In this embodiment, the drive member is provided with an impact surface 26. The viewing panel unit is provided with an abutment member 24 that is fixed relative to the outer panels 3 (i.e. so as to have a fixed spatial relationship with the outer panels 3) and/or, in use, the structure, e.g. door, within which the viewing panel unit itself is mounted.

In an embodiment, the abutment member 24 is positioned so that the impact surface 26 is brought into contact with a surface 28 of the abutment member 24 when the drive member 10 has been rotated through a maximum angle in one sense. FIG. 7 illustrates the case where the drive member 10 has been rotated through the maximum angle in the clockwise direction. FIG. 8 illustrates the case where the drive member 10 has been rotated through the maximum angle in the anticlockwise sense. The position of the abutment member 24 is chosen so that the impact between the impact surface 26 and the surface 28 will occur at a precise angle of rotation of the drive member 10. In this way, it is possible precisely to define the position of the coupling member 12 when the drive member 10 is at the maximum angle. As a consequence, it is possible accurately to determine the position of the centre panel 2 at the end of its range of motion. It is therefore possible to ensure that the desired alignment of features (e.g. opaque and/or transparent features, for example stripes) on different panels when the centre panel 2 is at the extreme ends of its range are achieved accurately and reproducibly.

As mentioned above, the approach of using an impact between the drive member 10 and an abutment member 24 rather than an impact between the centre panel 2 itself and an abutment member has various advantages. One of these advantages is the fact that the material of the drive member 10 can be chosen so as to be more appropriate to the function of supporting impacts, which is discussed in detail above. In an embodiment, the drive member 10 is formed from a material that is less brittle than the material of the centre panel 2. In an embodiment, the drive member 10 is formed from brass.

The drive member 10 may have lateral surfaces 30 extending away from the direction of the arc of the drive member engaging structure 20 at the point of intersection between the drive member engaging structure 20 and the lateral surface 30. For example, one or both of the lateral surfaces 30 may extend away at an oblique angle or at 90 degrees to the arc. In the example shown in FIGS. 7 and 8, the lateral surface 30 extends away from the arc at an angle of substantially 90 degrees. In an embodiment, each impact surface is formed within one of the lateral surfaces 30. In the example shown in FIGS. 7 and 8, each impact surface 26 is positioned at the point of intersection between the lateral surface 30 and the drive member engaging structure 20. This arrangement enables a maximal stopping torque to be achieved for a given size of force between the abutment member 24 and the drive member 10. This is achieved because the point of intersection between the lateral surface 30 and the drive member engaging structure 20 represents the point of the drive member 10 that is at the greatest distance from the axis of rotation of the drive member 10. However, in alternative embodiments, the impact surface may be provided at other positions along the lateral surface 30. In the examples shown, the lateral surfaces are both straight, but this is not essential. In alternative embodiments either or both of the lateral surfaces 30 may have more complex shapes, including curved sections and/or one or more elbows.

Figure 9:
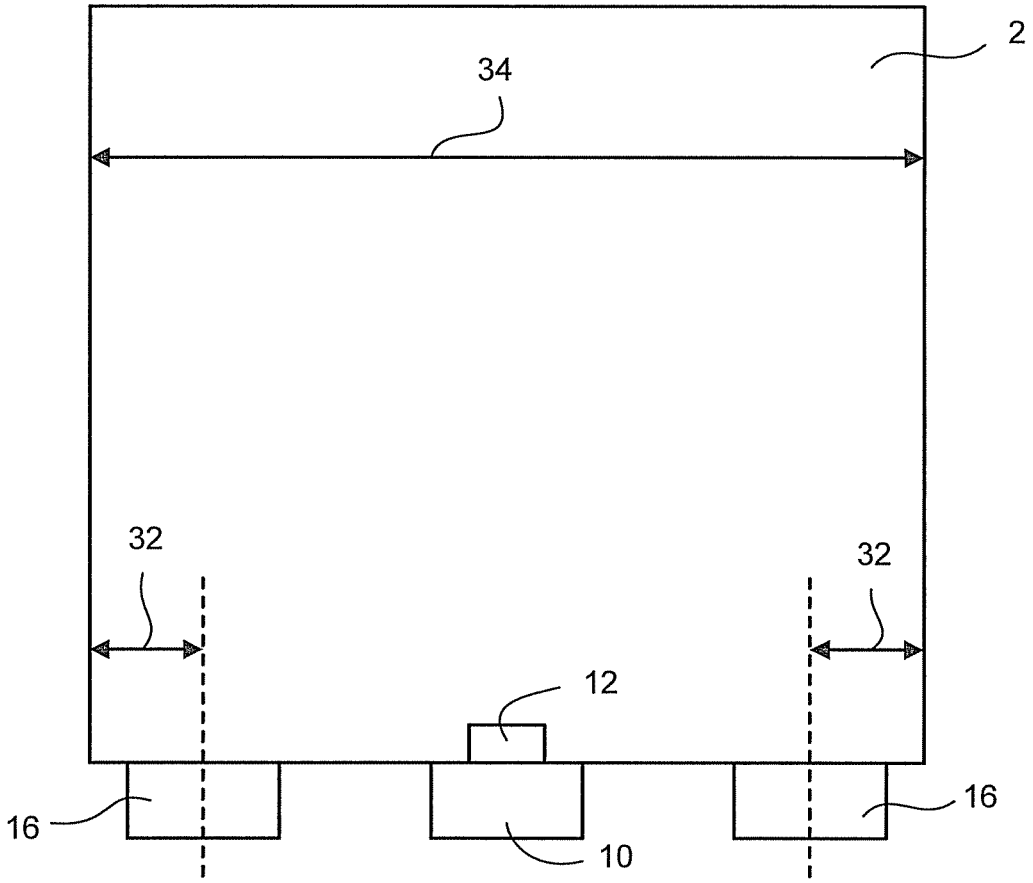
FIG. 9 is a schematic illustration of a moveable panel of a viewing panel unit showing the location of support members that engage with a lower surface of the panel.

FIG. 9 is a schematic view of a centre panel 2 supported by two support members 16. In this example, the support members 16 are configured to engage slidably with a lower surface of the centre panel 2 in order to support the weight of the centre panel 2. The support members 16 are each spaced apart from the region of engagement between the drive member 10 and the coupling member 12 in a direction parallel to the direction of linear motion of the centre panel 2 relative to the outer panels 3. Preferably, either or both of the support members 16 are positioned close to the lateral edges of the centre panel 2. For example, the separation 32 between the point of contact between the support member 16 and the centre panel 2 may be chosen to be less than 10% (optionally less than 5% or 2%) of the overall width 34 of the centre panel 2. It is expected that the centre panel will usually have a square or rectangular form so that the width 34 is constant as a function of height. However, where the width 34 does varies as a function of height, the separation 32 may be less than 10% (optionally less than 5% or 2%) of the average width, less than 10% (optionally less than 5% or 2%) of the smallest width and/or less than 10% (optionally less than 5% or 2%) of the greatest width.

Arranging the point of contact between the support member 16 and the centre panel 2 in this manner helps to ensure that the support member 16 can provide an effective counter torque to that applied to the centre panel 2 by the drive mechanism. In this way, the provision of the support members 16 help to prevent rotations of the centre panel 2 which may have a negative impact on the visual appearance of the viewing panel unit during use and/or which may interfere with the smooth operation of the drive mechanism, thereby reducing the ease with which a user can move the centre panel 2. The positioning of the support member 16 may also reduce the average size of forces applied to the support member 16 due to torques originating from the drive mechanism. Any such forces may tend to reduce the smoothness of the sliding movement, so it is desirable to keep them as small as possible.

Figure 10:
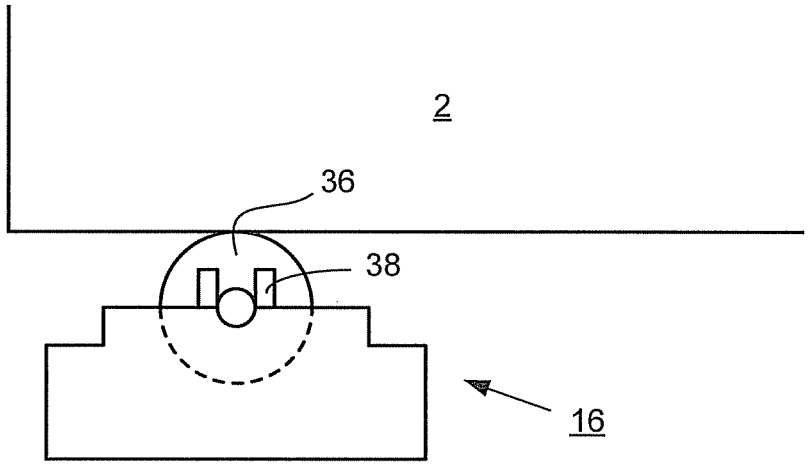
FIG. 10 is a schematic illustration of an example support member comprising a roller.

FIG. 10 shows an example support member 16 in further detail. In this example, the support member 16 comprises a roller 36 having an axis that is rotatably mounted within a cradle 38. The roller 36 can rotate freely to accommodate movement of the centre panel 2. The roller 36 thus provides an effective slidable engagement between the support member 16 and the centre panel 2. Other arrangements are also possible. For example, a region of low friction (using PTFE for example) could be provided between one or both of the support members 16 and the centre panel 2.

The concept of a support member 16 has been discussed above with reference to FIGS. 9 and 10 in the context of an example having two support members. However, the description is applicable, mutatis mutandis, to arrangements having less than two or more than two support members.

The viewing panel unit may be installed in a wide variety of structures. For example, a door, wall or partition comprising one or more of the viewing panel units may be provided.

The invention claimed is:

1. A viewing panel unit, comprising:

a first panel and a second panel;

a drive mechanism for moving the first panel relative to the second panel; and an abutment member mounted so as to have a fixed spatial relationship relative to the second panel, wherein:

the first panel comprises a coupling member;

the drive mechanism comprises a drive member configured to engage with the coupling member such that rotation of the drive member imparts a linear motion to the first panel via the coupling member; and the drive mechanism is configured such that a first impact surface of the drive member is brought into contact with a surface of the abutment member to stop the drive member when the drive member is rotated through a maximum angle in a first sense, wherein the drive member comprises a drive member engaging structure extending along an arc of constant radius of curvature, the drive member engaging structure being configured to engage with a linear coupling member engaging structure formed in the coupling member to move the first panel laterally to the axis of rotation of the drive member, and wherein the first impact surface is formed on a surface lateral of the drive member engaging structure.

2. The viewing panel unit according to claim 1, configured such that the drive member remains engaged with the coupling member when the drive member is rotated through the maximum angle in the first sense.

3. The viewing panel unit according to claim 1, wherein:

the surface of the abutment member is substantially planar.

4. The viewing panel unit according to claim 1, wherein:

the surface of the abutment member is substantially parallel to the direction of linear motion of the first panel.

5. The viewing panel unit according to claim 1, wherein:

the drive member engaging structure comprises an arc of teeth; and the coupling member engaging structure comprises a linear rack of teeth.

6. The viewing panel unit according to claim 1, wherein:

the drive member has a first lateral surface extending away from the direction of the arc of the drive member engaging structure at the point of intersection between the drive member engaging structure and the first lateral surface; and the first impact surface is formed in a portion of the first lateral surface.

7. The viewing panel unit according to claim 6, wherein:

the first impact surface is positioned at the point of intersection between the first lateral surface and the drive member engaging structure.

8. The viewing panel unit according to claim 1, wherein:

the drive mechanism is further configured such that a second impact surface of the drive member is brought into contact with a surface of the abutment member when the drive member is rotated through a maximum angle in a second sense, opposite to the first sense.

9. The viewing panel unit according to claim 8, wherein the drive member has a second lateral surface extending away from the direction of the arc of the drive member engaging structure at the point of intersection between the drive member engaging structure and the second lateral surface; and the second impact surface is formed in a portion of the second lateral surface.

10. The viewing panel unit according to claim 9, wherein:

the second impact surface is positioned at the point of intersection between the second lateral surface and the drive member engaging structure.

11. The viewing panel unit according to claim 1, further comprising:

a first support member configured to engage slidably with a lower surface of the first panel in order to support the weight thereof, the first support member being spaced apart from the region of engagement between the drive member and the coupling member in a direction parallel to the direction of linear motion of the first panel relative to the second panel.

12. The viewing panel unit according to claim 11, wherein the first support member comprises a roller to provide the slidable engagement.

13. The viewing panel unit according to claim 11, wherein the first support member is configured to come into contact with the first panel at a position that is within 10 percent of the width of the first panel of the nearest edge that extends away from the edge with which the first support member is in contact.

14. The viewing panel unit according to claim 11, further comprising a second support member configured to engage slidably with a lower surface of the first panel in order to support the weight thereof, the second support member being spaced apart from the region of engagement between the drive member and the coupling member in a direction parallel to the direction of linear movement of the first panel relative to the second panel.

15. The viewing panel unit according to claim 14, wherein the second support member comprises a roller to provide the slidable engagement.

16. The viewing panel unit according to claim 14, wherein the second support member is configured to come into contact with the first panel at a position that is within 10 percent of the width of the first panel of the nearest edge that extends away from the edge with which the second support member is in contact.

17. The viewing panel unit according to claim 1, wherein the first panel comprises one or more light transparent regions that are substantially transparent to visible light and one or more light hindering regions which substantially hinder transmission of visible light; and the second panel comprises one or more light transparent regions that are substantially transparent to visible light and one or more light hindering regions which substantially hinder transmission of visible light.

18. The viewing panel unit according to claim 17, wherein either or both of the light transparent regions and light hindering regions of either or both of the first and second panels form stripes.

19. The viewing panel unit according to claim 18, wherein the stripes are substantially perpendicular to the direction of linear motion of the first panel.

20. The viewing panel unit according to claim 17, wherein the drive member includes a second impact surface, and wherein:

when the first or second impact surface is in contact with the surface of the abutment member either:

at least one of the light transparent regions of the first panel are aligned with at least one of the light transparent regions of the second panel; or at least one of the light transparent regions of the first panel are aligned with at least one of the light hindering regions of the second panel.

21. The viewing panel unit according to claim 1, configured so as to be mounted such that the linear motion of the first panel is substantially horizontal.

22. A structure comprising the viewing panel unit according to claim 1 mounted within the structure.

23. The structure according to claim 22, wherein the viewing panel unit is mounted such that the linear motion of the first panel is substantially horizontal.

24. The structure according to claim 22, wherein the structure is a door, wall or partition.

* * * * *